US005951411A

United States Patent [19]

Wood et al.

[11] Patent Number: 5,951,411

[45] Date of Patent: Sep. 14, 1999

[54] HOSEL COUPLING ASSEMBLY AND METHOD OF USING SAME

[75] Inventors: Donald C. Wood; David W. Means, both of Carlsbad, Calif.

[73] Assignee: Zevo Golf Co., Inc., Temecula, Calif.

[21] Appl. No.: 09/003,073

[22] Filed: Jan. 5, 1998

[51] Int. Cl.[6] ..... A63B 53/02

[52] U.S. Cl. ..... 473/307

[58] Field of Search ..... 473/244, 245, 473/246, 248, 305, 306, 307, 308, 309, 310, 311, 312, 313, 314, 315, 288

[56] References Cited

U.S. PATENT DOCUMENTS

| | | |
|---|---|---|
| 1,426,202 | 8/1922 | Lard . |
| 1,540,559 | 6/1925 | Murphy . |
| 1,623,523 | 4/1927 | Bourke . |
| 1,669,836 | 5/1928 | Neuberth . |
| 1,844,812 | 2/1932 | Thorpe . |
| 1,994,149 | 3/1935 | Root . |
| 2,067,556 | 1/1937 | Wettlaufer . |
| 3,524,656 | 8/1970 | Wheeler . |
| 4,664,382 | 5/1987 | Palmer et al. . |
| 4,852,782 | 8/1989 | Wu et al. . |
| 4,895,368 | 1/1990 | Geiger . |
| 4,984,794 | 1/1991 | Pernelle et al. . |
| 5,039,098 | 8/1991 | Pelz . |
| 5,335,909 | 8/1994 | Green, Jr. . |
| 5,513,844 | 5/1996 | Ashcraft et al. . |
| 5,542,666 | 8/1996 | Chou . |
| 5,624,330 | 4/1997 | Tsuchida . |
| 5,772,901 | 3/1998 | Barron ..... 473/305 |

*Primary Examiner*—Sebastiano Passaniti
*Attorney, Agent, or Firm*—Higgs, Fletcher & Mack LLP; Bernard L. Kleinke

[57] ABSTRACT

The golf club construction includes a club head, an interchangeable shaft, and a hosel having a hosel bore extending between an open distal end and a closed end, and an alignment arrangement including an element thereof disposed at the closed end. A sleeve secured on the shaft end forms another alignment arrangement element and is adapted to be received within the bore to engage the alignment element therein. A capture mechanism disposed on the shaft engages the hosel at about the open end portion to fix releaseably the shaft relative to the club head.

12 Claims, 3 Drawing Sheets

FIG. 1
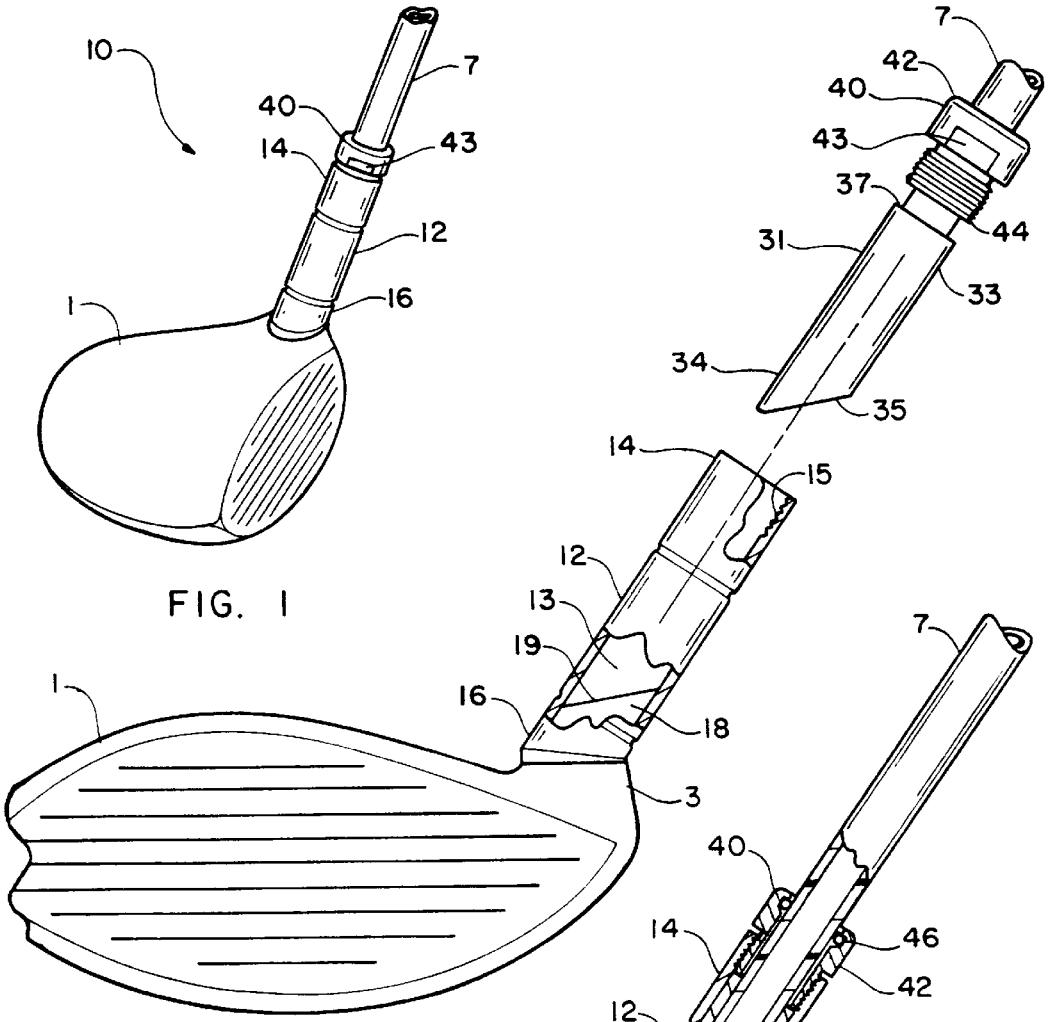
FIG. 2
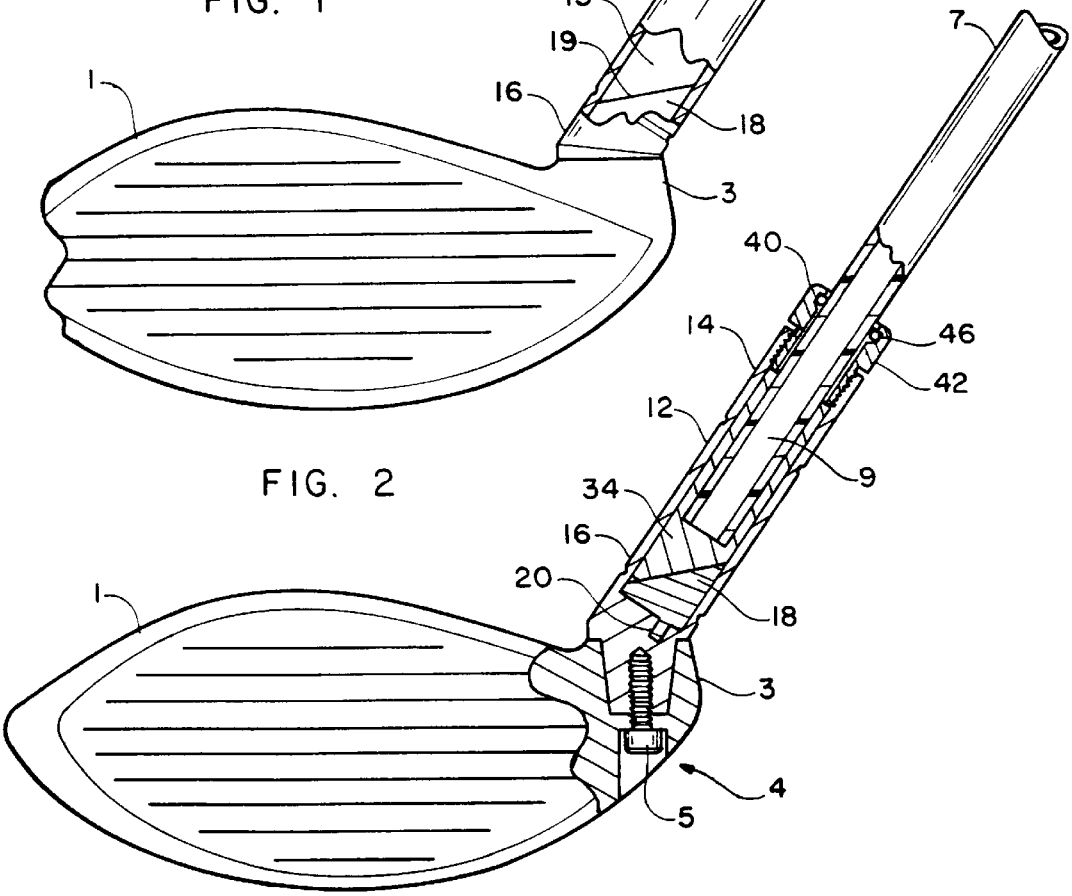
FIG. 3

HOSEL COUPLING ASSEMBLY AND METHOD OF USING SAME

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Technical Field

The present invention relates in general to a golf club construction employing a novel hosel coupling assembly for releaseably connecting a shaft to a club head, and a method of using it for interchangeably using different shafts. The invention relates more particularly to a hosel coupling assembly which facilitates interchanging various shafts with various club heads for fitting purposes according to a novel method.

2. Background Art

An important factor for achieving a successful golf game is the proper matching of a set of golf clubs to a particular golfer. Having a properly matched set of golf clubs enables the golfer to use the clubs without modifying the characteristics of the golfer's golf swing to accommodate the characteristics of the clubs. The most common way for the golfer to obtain a properly matched set of golf clubs has been selecting off-the-shelf golf clubs with predefined, fixed characteristics. Such off-the-shelf clubs provided some variations to suit golfer's having various different golf swing characteristics, but could not address the golf swing characteristics of every individual golfer. In this regard, an exemplary set of golf clubs includes a number of similar clubs, such as irons or woods, having different characteristics to facilitate a variety of golf club/golf ball interactions for achieving different types of desired golf shots. Thus, while a set of off-the-shelf golf clubs may have permitted a golfer to obtain at least one golf club in the set which was suited for the golfer's golf swing characteristics, it was unlikely that every golf club in the selected set was suited for the golf swing characteristics of that golfer to achieve all of the desired golf shots.

Golf clubs having a club head that was detachable from a shaft were proposed to enable a golfer to obtain a set of golf clubs utilizing the same shaft. Thus, a number of club heads having the appropriate variations could be utilized with a single shaft adapted to the golfer's golf swing characteristics to achieve the desired golf shots. For example, reference may be made to the following U.S. patents disclosing such detachable club head/shaft combinations: U.S. Pat. Nos. 1,669,836; 3,524,646; 4,664,382, and 4,852,782.

More recently, the use of customized golf clubs has enabled golf clubs to be produced which more closely fit the individual golf swing characteristics of any golfer. U.S. Pat. No. 5,039,098 disclosed a coupling for enabling a club head to be interchangeable with a shaft. By permitting the club head and shaft to be interchangeable, the coupling enabled a variety of club head/shaft combinations to be assembled. In this way, a suitable club head/shaft combination could be selected to accommodate the golfer's golf swing characteristics.

Although the coupling disclosed in U.S. Pat. No. 5,039,098 provided some flexibility in the selection of golf clubs adapted especially for an individual golfer, the patented coupling was not capable of adjusting all of the characteristics of the golf clubs to match the golf swing characteristics of the golfer. In particular, the disclosed coupling did not permit any variation in connection with angular relationships between the club head and shaft, including club lie angle and club face angle.

Therefore, it would be highly desirable to have a new and improved hosel coupling assembly, and method of using it, for substantially increasing the number of possible variations in the club head/shaft combination to fit an individual golfer's golf swing characteristics.

A hosel construction was disclosed in co-pending and commonly owned U.S. patent application Ser. No. 08/923,546 filed Sep. 4, 1997, entitled "HOSEL CONSTRUCTION AND METHOD OF MAKING THE SAME," (the "Hosel application") for facilitating the assembly of customized golf clubs, which application is incorporated by reference as if fully set forth herein. The disclosed hosel construction included a plug member at a fixed relationship relative to a neck portion to help define angular relationships between the club head and the shaft. By utilizing a set of the hosel constructions, each having a unique plug member/neck portion relationship, a particular one of the group of hosel constructions could be selected to match the golf swing characteristics of a particular golfer. In this way, a desired hosel construction could be selected for a given golfer for each golf club in a golf club set to provide a customized set of golf clubs for the user.

While the hosel construction disclosed in the Hosel application increased the number of possible angular relationships between the club head and the shaft to help fit an individual golfer's golf swing characteristics to the golfer, the disclosed hosel construction did not facilitate the matching of shaft characteristics to the golf swing characteristics.

Therefore, it would also be highly desirable to have a new and improved hosel coupling assembly for joining a shaft to a club head to form a golf club adapted for the swing characteristics of an individual golfer, and for permitting alternative shafts to be joined to the club head to further refine the golf club characteristics to match the golf swing characteristics of the golfer. Such a hosel coupling assembly should permit the coupling of a shaft to a club head in a quick and easy manner, and should facilitate producing customized golf clubs according to a novel modular system of fitting golf clubs to individual golfers.

SUMMARY OF THE INVENTION

Therefore, the principal object of the present invention is to provide a new and improved golf club construction, and method of using it, wherein the golf club construction facilitates the interchangeability of various different shafts for testing purposes to help determine desired shaft characteristics.

Another object of the present invention is to provide such a new and improved golf club construction and method, which facilitates assembling a customized golf club quickly and easily according to a novel modular system of fitting golf clubs utilizing the golf club construction of the present invention.

Briefly, the above and further objects of the present invention are realized by providing a new and improved golf club construction having a novel hosel coupling assembly which facilitates the combining of desired club head/shaft angular relationships and desired shaft characteristics. The hosel coupling assembly further facilitates assembling the customized golf club quickly and easily to define a customized golf club for the user in accordance with a novel modular system of fitting golf clubs.

The golf club construction includes a club head, an interchangeable shaft and a hosel having a hosel bore extending between an open distal end and a closed end, and an alignment arrangement including an element thereof disposed at the closed end. A sleeve secured on the shaft end forms another alignment arrangement element and is adapted to be received within the bore to engage the alignment element therein. A capture mechanism disposed on the shaft engages the hosel at about the open end portion to fix releaseably the shaft relative to the club head.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 1 is a pictorial, partially broken away view of a golf club construction including a shaft coupled to a club head by a hosel coupling assembly which is constructed in accordance with the present invention;

FIG. 2 is a partially broken-away enlarged elevation view of the golf club construction of FIG. 1, illustrating the shaft dissembled from the club head;

FIG. 3 is a vertical sectional view of the golf club construction with the shaft coupled to the club head;

BEST MODE FOR CARRYING OUT THE INVENTION

Figures 4, 5, 6, 6A:
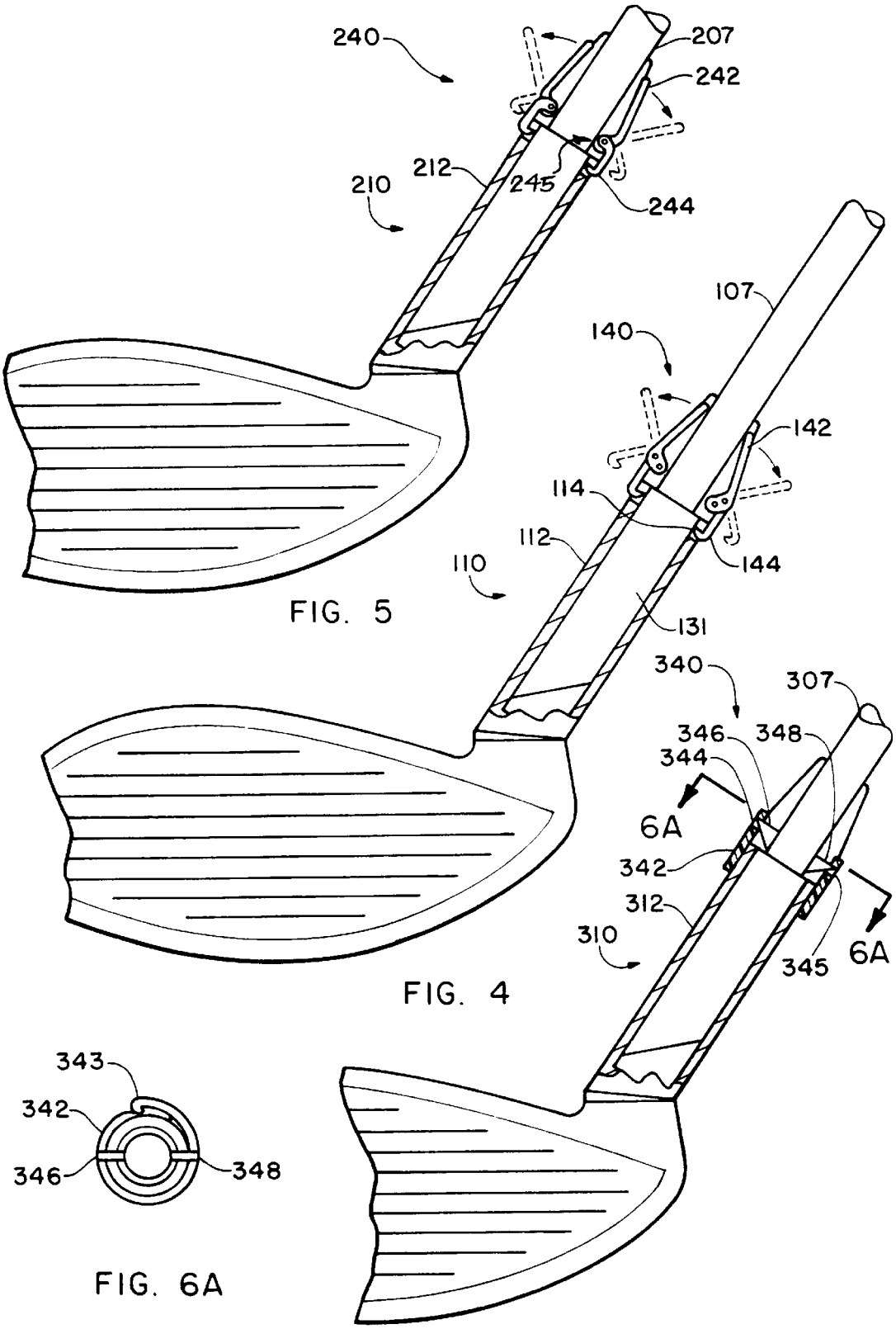
FIG. 4 is a broken-away partially diagrammatic view of another golf club construction which is also constructed in accordance with the present invention.
FIG. 5 is a broken-away partially diagrammatic view of another golf club construction which is also constructed in accordance with the present invention.
FIG. 6 is a broken-away partially diagrammatic view of another golf club construction which is also constructed in accordance with the present invention.
FIG. 6A is a sectional view of the golf club construction of FIG. 6 taken substantially on line 6A—6A thereof.

Referring now to the drawings, and more particularly to FIGS. 1–3 thereof, there is shown a golf club construction 10 which is constructed in accordance with the present invention. As shown in FIGS. 1 and 3, the golf club construction includes a club head 1 connected releasably to a shaft 7 for fitting and testing purposes according to a modular fitting system described hereinafter in greater detail. While the construction 10 is preferably used for fitting and testing purposes, the construction 10 can be used to assemble a golf club for participating in a game of golf if the rules permitted the use of such a golf club.

As shown in FIGS. 1–3, the club head 1 is of the type generally referred to as a wood. It will be understood by one skilled in the art that the club head 1 could be another type of golf club head, such as an iron.

The construction 10 generally includes a hosel 12 having a bore 13 extending from an open end portion generally indicated at 14 to a closed end portion 16, and fixed to a heel portion 3 of the club head 1 by a coupling arrangement 4 (FIG. 3) including a screw 5 extending through a hole in the bottom of a bore and into a plug member in the hosel 12. The hosel 12 is substantially similar to the interchangeable hosel construction disclosed in the forementioned Hosel application, and enables a desired lie angle and a desired face angle to be defined for the club head 1 relative to the shaft 7 of the golf club construction 10 to accommodate the swing characteristics of an individual golfer (not shown).

The construction 10 further includes a sleeve member 31 secured on a bottom end portion 9 of the shaft 7, and an alignment and splicing member or wedge shaped block 18 for cooperating with the sleeve member 31 to locate the bottom end of the shaft 7 within the hosel 12 relative to the club head 1 and to form an effective releasable splice between the shaft 7 and the hosel 12. A capture mechanism 40 is disposed about the shaft 7, and is adapted to engage fixedly releasably the hosel 12 at about its open end 14 to retain releasably the sleeve 31 within the bore 13.

The alignment member 18 is fixed within the hosel bore 13, and includes a member or stud 20 for press fitted within an opening in the closed end portion 16 of the hosel 12, to prevent substantially the member 18 from rotating within the hosel bore 13 and to secure the member fixedly in place. The member 18 serves as a stop member for engaging the sleeve 31 when it is inserted within the hosel bore 13, and includes an angular surface 19 (FIG. 2) for cooperating with the sleeve 31 to locate the shaft 7 relative to the club head 1. As best seen in FIG. 2, a closed end portion 34 of the shaft sleeve 31 includes an angled surface 35 which cooperates with the mating angled surface 19 when the sleeve 31 is received in the hosel bore 13 to position the shaft 7 in axial alignment with the member 18 and thus to complete a splice between the shaft 7 and the hosel 12.

A bore within the sleeve 31 receives the shaft 7 at an open end portion 33. The sleeve 31 is secured to the shaft bottom end portion 9 by a suitable adhesive.

The capture mechanism generally indicated at 40 is mounted axially slidably on the shaft 7, and loosely and freely surrounds the shaft 7 to couple it to the hosel 12. The mechanism 40 is a captured nut, which includes an annular head portion 42 and an externally threaded tubular shank portion 44. The threaded portion 44 engages threadably a hosel internally threaded portion 15 disposed at the hosel open end portion 14 when the sleeve 31 is inserted within the hosel 12 to enable the capture nut 40 to be tightened. When the shaft is assembled to the hosel 12 with the shaft sleeve 31 received within the bore 13, as shown in FIG. 3, the end of the threaded portion 44 abuts a shoulder 37 at the sleeve open end portion 33 to retain the sleeve 31 in releasably fixed engagement with the member 18.

A pair of flats, such as flat 43, on diametrically opposed sides of the head portion 42 enable a wrench or other suitable tool (not shown) to grasp the head portion 42 for rotating the mechanism 40 to help secure or remove it from the hosel 12. However, the capture nut 40 can be inannually tightened or loosened without the aid of a tool. An O-ring 46 is disposed between the head portion 42 and the shaft 7 to protect the shaft 7 from being marred or scratched during the tightening or loosening of the capture nut 40.

The durability of the connection accomplished by the hosel coupling assembly 10 has been proven to be sufficient to maintain the fixed relationship between the club head 1 and the shaft 7 even after a substantial number of uses of the golf club have been effected, and after a model of the golf club constructed according to the invention was subjected to destructive testing. Thus, the inventive golf club construction enables a golfer to test a golf club with various different shafts to determine which shaft is best suited to his or her golf serving. In so doing, the golf club being tested can be used by the golfer for hitting a golf ball, without the golf club becoming disassembled or otherwise distorted in the process of being tested.

In operation, the hosel 12 is selected to provide a desired club lie angle and club face angle as described in the Hosel application, and is secured to the club head 1 by the coupling arrangement 4.

The desired shaft 7, having the sleeve 31 secured thereto, is then selected to match the golf swing characteristics of the individual golfer. The desired shaft 7 can be selected in accordance with the method for fitting golf clubs disclosed in copending and commonly owned U.S. patent application Ser. No. 08/799,072 filed Feb. 11, 1997, and entitled "METHOD FOR FITTING GOLF CLUBS FOR GOLFERS," (the "Fitting application"), which application is incorporated by reference as if fully set forth herein.

The bottom end of the shaft 7 is inserted into the bore 13 until the sleeve 31 bottoms against or engages the member 18. The shaft 7 is then rotated until the angled surface 35 engages and mates with the couple-inventory angled surface 19, wherein the sleeve 31 and shaft 7 are axially aligned with the member 18.

To secure the shaft 7 within the bore 13, the capture nut 40 is moved axially slidably into engagement with the internal threaded portion 15. The nut head portion 42 is rotated manually or with the aid of a tool (not shown) to threadably engage the threaded portion 44 until the bottom end of the nut 40 engages the shoulder 37 and can not be rotated further, thereby securing fixedly releasably the shaft 7 relative to the club head 1.

The removal of the shaft 7 from hosel 12 is effected by rotating in the opposite direction the nut head portion 42 until the threaded portion 44 is freed from the threaded portion 15. Once the capture nut 40 is freed from the threaded portion 15, the shaft 7 and sleeve 31 can be removed from the bore 13 and a similar shaft (not shown) can be attached to the head 1.

Figure 7:
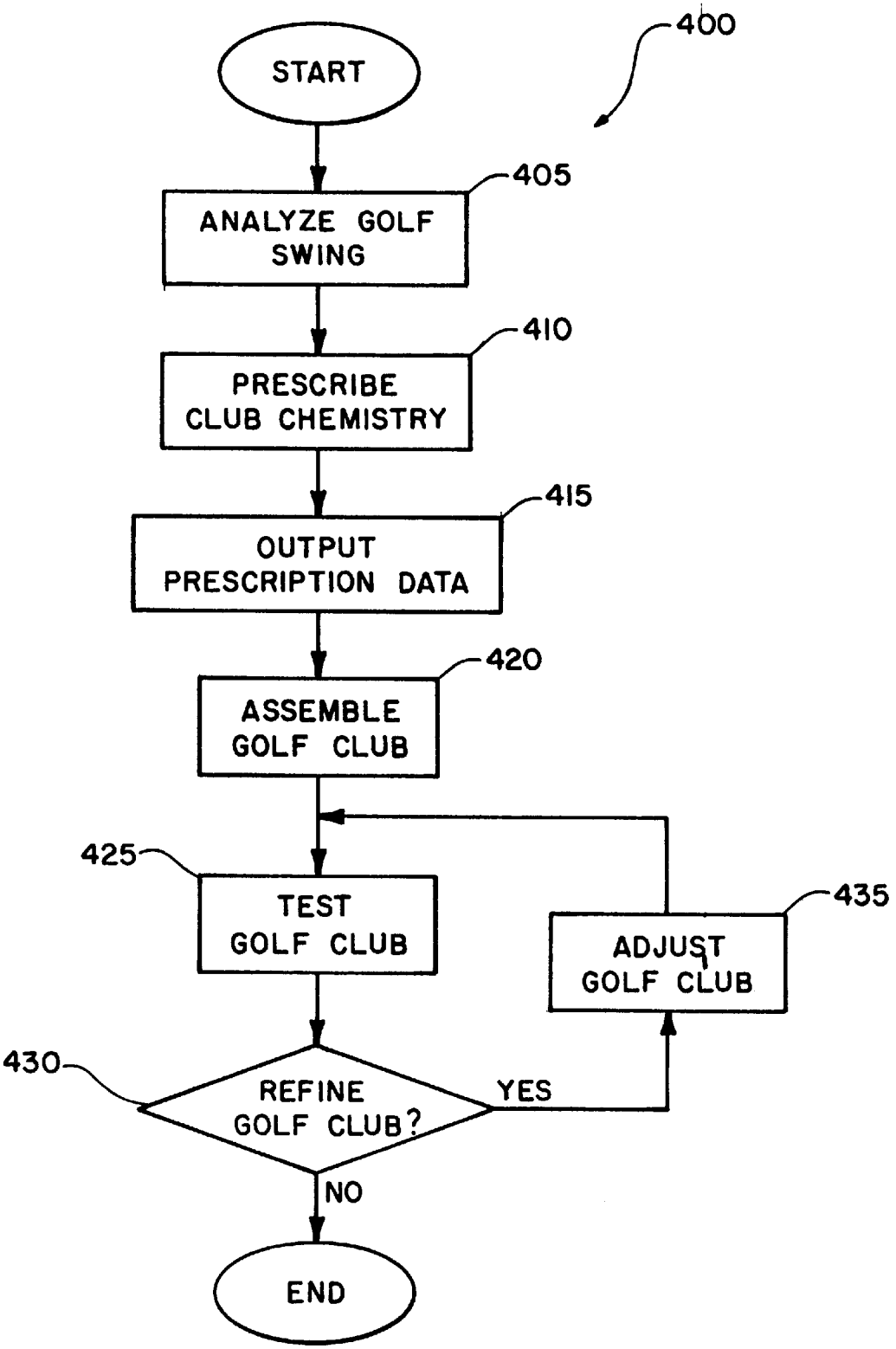
FIG. 7 is a flow chart for a modular fitting method for fitting a golfer using the golf club construction of FIG. 1 according to the present invention.

Considering now a fitting system or method according to the present invention with reference to FIG. 7, there is shown a flow chart 400 illustrating a modular fitting system or method using the golf club construction 10 (FIGS. 1–3). The modular fitting system facilitates determining the appropriate golf club characteristics for producing a customized golf club (not shown) for the individual golfer. Initially, the golf swing characteristics of the individual golfer are analyzed at box 405. The analysis of the golf swing characteristics can be accomplished with an electronic swing analyzer, such as the swing analyzer shown and described in U.S. Pat. No. 5,474,298 incorporated by reference as if fully set forth herein, or by observation of a golfing professional. Based on the analysis of the swing characteristics, a desired club chemistry is prescribed at box 410. The club chemistry is preferably prescribed in accordance with the fitting system described in the Fitting application.

As described in the Fitting application, the golf swing characteristics are utilized by the fitting system to determine "primal" swing characteristics of the individual golfer. Utilizing the determined primal swing characteristics, particular club parameters are specified to define a reference club customized for the individual golfer. The club parameters include club head parameters, such as club head face angle, club head lie angle, club head weight, loft, and club head offset, as well as shaft parameters such as, for example, as shaft weight, shaft flex, shaft bend point, material shaft torque and shaft grip size.

Once the reference club parameters for the individual golfer are determined at box 410, the reference club parameters are output as club prescription data at box 415. The output of the prescription data can be accomplished with a display device or a printing mechanism.

The club prescription data enables a fitted or customized test club to be assembled from modular golf club parts. For example, as shown and described in the Hosel application, a set of hosels can be provided. Each hosel of the set has a particular arrangement to define a particular club head face angle or club head lie angle. By associating club prescription data with each hosel of the set of hosels, the appropriate hosel can be selected to match the club prescription data as determined at box 410.

In addition to the set of hosels, it is also contemplated that a set of shafts having sleeves, such as sleeve 31 (FIGS. 1–3), be provided. Each one of the shafts has a particular characteristic or particular group of characteristics. For example, the group of shafts could include shafts made from different materials, shafts having different lengths, and shafts having different grip sizes. Using the club prescription data, an appropriate shaft could be selected from the group of shafts for the individual golfer.

The reference club is assembled from the selected elements, such as the appropriate hosel and shaft, at box 420. The assembled reference club embodies the reference club parameters indicative of the desired club chemistry.

The assembled reference club is tested by the individual golfer at box 425 to ensure the club functions as intended. The testing of the assembled reference club preferably involves a sufficiently large number of test swings, with or without contacting a golf ball, to determine whether the desired club chemistry has been achieved with the reference club. A determination is made at decision box 430 as to whether the reference club is suitable, or if refinements to the reference club are required. In the event a refinement is necessary, the reference club is adjusted at box 435 before testing at box 425 again. Further refinement can be made in a similar manner.

The shaft interchangeable golf club construction 10 (FIGS. 1–3) facilitates the quick and easy refinement of shafts or other required components such as hosels and lofts. For example, a stiffer shaft can be selected from the set of shafts to replace an originally specified shaft that was determined by the golfer to be too soft during testing at box 425. Using the construction 10, the shafts can be substituted easily and quickly. If the shaft meets the desired result but the hosel does not achieve the desired head loft or other characteristic controlled by the hosel the required alteration can be achieved quickly as a result of the method and apparatus of the present invention.

Once it is determined at box 430 that no refinements are required, or no further refinements are required, the reference club is deemed to embody the desired club chemistry. The reference club parameters are then utilized to manufacture a customized golf club which is made to the characteristics of the individual golfer. Thereafter, a customized golf club incorporating the desired characteristics can be constructed for the individual golfer.

The flowchart 400 can be used to determine reference club parameters for additional golf clubs for the individual golfer. In this way, a complete set of customized golf clubs can be specified for the golfer to facilitate achieving a successful golf game.

Referring now to FIG. 4, there is shown another golf club construction 110 which is also constructed in accordance with the present invention. The construction 110 facilitates coupling releaseably a shaft 107 having a sleeve 131 secured thereon to a hosel 112. The sleeve 131 is generally similar to the sleeve 31 of FIG. 1, and the hosel 112 is generally similar to the hosel 12 of FIG. 1.

The 110 includes a capture mechanism generally indicated at 140 having one or more over center latching levers, such as a lever 142, distributed about the shaft 107, and pivotally coupled thereto. A catch member or hook 144 is pivotally coupled to the lever 142, offset from the shaft/lever pivot point, and is adapted for engaging an opening 114 in the hosel 112.

In operation, the sleeve 131 is inserted into the hosel 112. With the lever 142 extended away from the shaft 107, the catch member 144 is urged into the hosel opening 114. The lever 142 is then pivoted in the direction of the arrow toward the shaft 107, wherein the catch member 144 engages the hosel 112 at the opening 14 to substantially prevent the sleeve 131 from being removed from the hosel. Once the member 144 is hooked in place, the lever 142 is pivoted into the solid line position of FIG. 4 in an over center position to retain the shaft construction in place. The other lever or levers are pivoted in a similar manner to securely and releaseably couple the shaft 107 to the hosel 112.

The shaft 107 is removed from the hosel 112 by pivoting the levers such as the lever 142 away from the shaft 107, thereby permitting the catch member 144 to be freely removed from the opening 114. Once all of the levers have been pivoted away from the shaft 107, the sleeve 131 can be backed out of the hosel 112.

Referring new to FIG. 5, there is shown another golf club construction 210 which is also constructed in accordance with the present invention. The construction 210 is substantially similar to the construction 110 (FIG. 4) and includes a capture mechanism generally indicated at 240 for coupling a shaft 207 to a hosel 212. The capture mechanism 240 is similar to the mechanism 140 (FIG. 4), except that the mechanism is cam actuated.

The capture mechanism 240 includes one or more latching levers, such as a lever 242, and an associated catch member 244. To facilitate applying a varying force on the catch member 244 for securing the shaft 207 to the hosel 212, the catch member 244 is pivotally connected to the lever 242 at an eccentric camming portion thereof as indicated at 245.

Referring now to FIGS. 6 and 6A, there is shown another golf club construction 310 which is also constructed in accordance with the present invention. The construction 310 includes a capture mechanism generally indicated at 340 for coupling a shaft 307 to a hosel 312, which is generally similar to the hosel 12 of FIG. 1. The capture mechanism 340 includes a removable generally cylindrical tubular collar 342 attached to and surrounding the hosel 312. The collar 342 is split axially, and is preferably constructed from a durable resilient material to enable the collar 342 to be wrapped about the top portion of the hosel to facilitate the removal and placement of the collar 342 relative to the shaft 307 and hosel 312. A latching portion 343 at the ends of the collar 342 helps to retain the collar 342 on the hosel 312.

The collar 342 includes circumferentially spaced openings 344 and 345 (FIG. 6) for cooperating with triangularly shaped projections or barbs 346 and 348 extending outwardly from the shaft 307 to retain the shaft 307 within the hosel 312. It should be noted that the barbs can be alternatively connected to and extend from a sleeve 331 at the bottom end of the shaft 307. Also, there can be a series of axially spaced apart barbs (not shown) which can be used to tighten the shaft to the hosel in a manner similar to a ratchet. The projections 346 and 348 are preferably adapted to cam the collar 342 outwardly as the shaft 307 is inserted into the hosel 312. Once the projections 346 and 348 are received within the respective openings 344 and 345, the collar 342 prevents releasably the shaft 307 from being separated from the hosel 312.

The removal of the shaft 307 from the hosel 312 is affected by removing the collar 342 by freeing the latching portion 343. Once removed, the collar 342 moves out of engagement with the projections 346 and 348 to enable the shaft to be freely removed from the hosel.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A golf club construction, comprising:

a golf club head;

a shaft having a bottom end portion connected releasably to the club head;

a hosel on said club head having a hosel bore extending from an open end portion to a closed end portion;

alignment and splicing means having a member disposed at said closed end portion of said hosel for helping to locate and splice the shaft relative to the club head;

said alignment and splicing means comprising an alignment and splicing member further including a sleeve secured on the shaft bottom end portion and adapted for insertion into said hosel bore to engage matingly said member of said alignment means; and a releasable capture mechanism disposed on the shaft for engaging said hosel proximate said open end portion to retain releasably said sleeve within said hosel bore to fix the shaft releaseably relative to the club head.

2. A golf club construction according to claim 1, wherein said capture mechanism includes a captured nut.

3. A golf club construction according to claim 2, wherein said captured nut includes a head portion and an externally threaded tubular shank portion.

4. A golf club construction according to claim 1, wherein said alignment means member includes an angular surface, and said sleeve has another complementary angular surface, said another complementary angular surface being adapted to position the shaft in axial alignment with a stop member when said sleeve is received in said hosel bore and to splice the end of the shaft with the hosel.

5. A golf club construction according to claim 4, further including a projection extending from said alignment and splicing member secured within an opening in said hosel at said closed end portion to fix the member within said hosel.

6. A golf club construction according to claim 1, further including a hosel internally threaded portion in said hosel bore at said outer end portion, and wherein said releasable capture mechanism includes a captured nut having a head portion and an externally threaded shank portion for engaging said hosel internally threaded portion to fix releasably said sleeve within said bore.

7. A golf club construction according to claim 1, wherein said open end portion, and said capture mechanism includes an over center lever connected pivotally to the shaft and a catch member coupled pivotally to said lever, wherein said lever is operable to retain and release said catch member relative to an opening in said hosel.

8. A golf club construction according to claim 1, wherein said capture mechanism includes a lever and catch member coupled pivotally to the shaft, said lever having an eccentric camming portion to vary the position of said catch member as said lever is pivoted, wherein said lever is operable to retain and release said catch member relative to an opening in said hosel.

9. A golf club construction according to claim 1, wherein said capture mechanism includes a collar having at least one opening therein and disposed about said hosel wherein said shaft includes at least one projection received in said opening to secure the shaft within said hosel.

10. A method of assembling a golf club, comprising:

using said hosel having a hosel bore, using alignment and splicing means within the bore, using a sleeve secured to said shaft, and using a capture mechanism disposed about the shaft;

inserting said sleeve within said bore;

engaging said alignment and splicing means with said sleeve to position said shaft relative to said club head when said sleeve is received in said bore; and engaging an open end of said hosel with said capture mechanism to retain releasably said sleeve within said bore.

11. A method of assembling a golf club according to claim 10, further including securing said hosel to said club head.

12. A method of assembling a golf club according to claim 10, further including axially aligning said shaft with said alignment means.

* * * * *